US012716645B2

(12) United States Patent
Roth et al.

(10) Patent No.: US 12,716,645 B2
(45) Date of Patent: Aug. 25, 2026

(54) WIRE AND CONDUIT MOUNTING HARNESS ASSEMBLIES FOR A REFRIGERATOR APPLIANCE

(71) Applicant: Haier US Appliance Solutions, Inc., Wilmington, DE (US)

(72) Inventors: Daniel Roth, Clarksville, IN (US); Jeremy Joseph Ryan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 8 days.

(21) Appl. No.: 18/829,921

(22) Filed: Sep. 10, 2024

(65) Prior Publication Data

US 2026/0071810 A1 Mar. 12, 2026

(51) Int. Cl.
*F25D 23/06* (2006.01)
*F25D 23/12* (2006.01)

(52) U.S. Cl.
CPC ..... *F25D 23/061* (2013.01); *F25D 23/126* (2013.01); *F25D 2400/40* (2013.01)

(58) Field of Classification Search
CPC .... F25D 23/061; F25D 23/028; F25D 23/126; F25D 2323/024; F25D 2400/40; F25D 2323/121; F25D 2323/122
See application file for complete search history.

(56) References Cited

U.S. PATENT DOCUMENTS

| | | | | |
|---|---|---|---|---|
| 574,236 | A * | 12/1896 | Blackburn | F16L 21/022 285/109 |
| 5,941,619 | A * | 8/1999 | Stieben | F25D 23/028 312/405 |
| 5,985,189 | A | 11/1999 | Lynn et al. | |
| 8,117,865 | B2 * | 2/2012 | Allard | H05K 5/0247 62/449 |
| 8,281,608 | B2 * | 10/2012 | Kuehl | F16L 47/32 62/259.1 |
| 8,695,370 | B2 * | 4/2014 | Coulter | F25D 23/12 62/424 |
| 8,938,985 | B2 * | 1/2015 | Lim | C02F 1/001 62/338 |
| 10,082,232 | B2 | 9/2018 | Christian, Jr. et al. | |
| 10,415,867 | B2 * | 9/2019 | Yang | F25D 23/12 |
| 11,293,688 | B2 * | 4/2022 | Chhajed | F25D 23/066 |
| 11,415,363 | B2 | 8/2022 | Lim et al. | |
| 11,898,676 | B2 * | 2/2024 | Gardner | F16L 37/144 |

(Continued)

FOREIGN PATENT DOCUMENTS

| | | | |
|---|---|---|---|
| CN | 205641755 U | * | 10/2016 |
| CN | 107634485 B | | 9/2020 |

(Continued)

*Primary Examiner* — Andrew Roersma
(74) *Attorney, Agent, or Firm* — Dority & Manning, P.A.

(57) ABSTRACT

A refrigerator appliance includes a cabinet defining a chilled chamber, door being rotatably mounted to the cabinet to provide selective access to the chilled chamber, a harness housing mounted to the cabinet and defining a conduit adapter, and a waterline conduit routed through the cabinet, the waterline conduit defining a connecting portion for receipt within the conduit adapter and a plurality of protruding ribs extending from an outer surface of the waterline conduit.

18 Claims, 5 Drawing Sheets

(56) References Cited

U.S. PATENT DOCUMENTS

| | | | | |
|---|---|---|---|---|
| 2005/0173323 | A1* | 8/2005 | Meuleners | F25D 23/126 210/282 |
| 2007/0204648 | A1* | 9/2007 | Smale | F25D 23/126 62/440 |
| 2015/0076817 | A1 | 3/2015 | Bizzarrini | |
| 2019/0128595 | A1* | 5/2019 | Gan | F25D 23/126 |
| 2020/0056824 | A1* | 2/2020 | Lee | F25D 17/065 |
| 2020/0247656 | A1* | 8/2020 | Kwon | B67D 1/0014 |
| 2021/0293469 | A1* | 9/2021 | Temizkan | B67D 3/0009 |
| 2022/0034581 | A1* | 2/2022 | You | F25D 23/006 |
| 2023/0332823 | A1* | 10/2023 | Kwon | F25D 23/04 |
| 2023/0380707 | A1 | 11/2023 | Weems et al. | |

FOREIGN PATENT DOCUMENTS

| | | | | | |
|---|---|---|---|---|---|
| CN | 213300561 | U | * | 5/2021 | |
| CN | 219868725 | U | | 10/2023 | |
| CN | 220669888 | U | | 3/2024 | |
| DE | 102009045900 | A1 | * | 4/2011 | F16L 5/025 |
| DE | 102012216374 | A1 | * | 3/2014 | F25D 23/126 |
| DE | 202016104462 | U1 | | 11/2017 | |
| JP | 2001272162 | A | * | 10/2001 | F25D 23/02 |
| KR | 1020120063615 | A | * | 6/2012 | F25D 11/02 |
| KR | 101205104 | B1 | * | 11/2012 | F25C 1/25 |
| KR | 102079367 | B1 | * | 2/2020 | |
| WO | WO-2018065214 | A1 | * | 4/2018 | F25D 23/126 |
| WO | WO-2024102918 | A1 | * | 5/2024 | B01D 35/02 |

* cited by examiner

WIRE AND CONDUIT MOUNTING HARNESS ASSEMBLIES FOR A REFRIGERATOR APPLIANCE

FIELD

The present subject matter relates generally to refrigerator appliances, and more particularly wire and conduit harnesses in refrigerator appliances.

BACKGROUND

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

Certain conventional refrigerator appliances include a waterline conduit that is routed through the cabinet (e.g., between the cabinet and a liner) prior to injecting foam into the cabinet. After the waterline conduit is foamed in place, a water supply line may be routed through the waterline conduit. However, conventional waterline conduits to a harness housing positioned proximate the door hinge using a loose friction fit. In addition, tape is commonly applied to the conduit connections, which results in increased manufacturing time and costs. Finally, this connection may be prone to foam leakage, which can result in failure of the waterline conduit and the inability to subsequently route the water supply line.

In addition, conventional refrigerator appliances utilize a grommet to route wires from the inside to the outside of the cabinet using an interference fit. However, the interference fit grommet is not effective at preventing foam leaks and leads to high scrap/repair rates which in turn results in increased costs and repair time. A tighter interference fit would make assembly difficult and may result in technician fatigue or injuries.

Accordingly, a refrigerator appliance with systems for simplifying the routing of conduit and wiring would be useful. More particularly, a refrigerator appliance that includes features to facilitate conduit/wiring routing and simplifying the spray foam insulation process would be particularly beneficial.

BRIEF DESCRIPTION

Aspects and advantages of the invention will be set forth in part in the following description, or may be apparent from the description, or may be learned through practice of the invention.

In one exemplary embodiment, a refrigerator appliance is provided including a cabinet defining a chilled chamber, door being rotatably mounted to the cabinet to provide selective access to the chilled chamber, a harness housing mounted to the cabinet and defining a conduit adapter, and a waterline conduit routed through the cabinet, the waterline conduit defining a connecting portion for receipt within the conduit adapter and a plurality of protruding ribs extending from an outer surface of the waterline conduit.

In another exemplary embodiment, a harness connecting assembly for a refrigerator appliance is provided. The refrigerator appliance includes a cabinet defining an aperture. The harness connecting assembly includes a harness housing inserted through the aperture of the cabinet, the harness housing comprising a plurality of clips to secure the harness housing to the cabinet and a conduit adapter, and a waterline conduit routed through the cabinet, the waterline conduit defining a connecting portion for receipt within the conduit adapter and a plurality of protruding ribs extending from an outer surface of the waterline conduit to engage the conduit adapter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
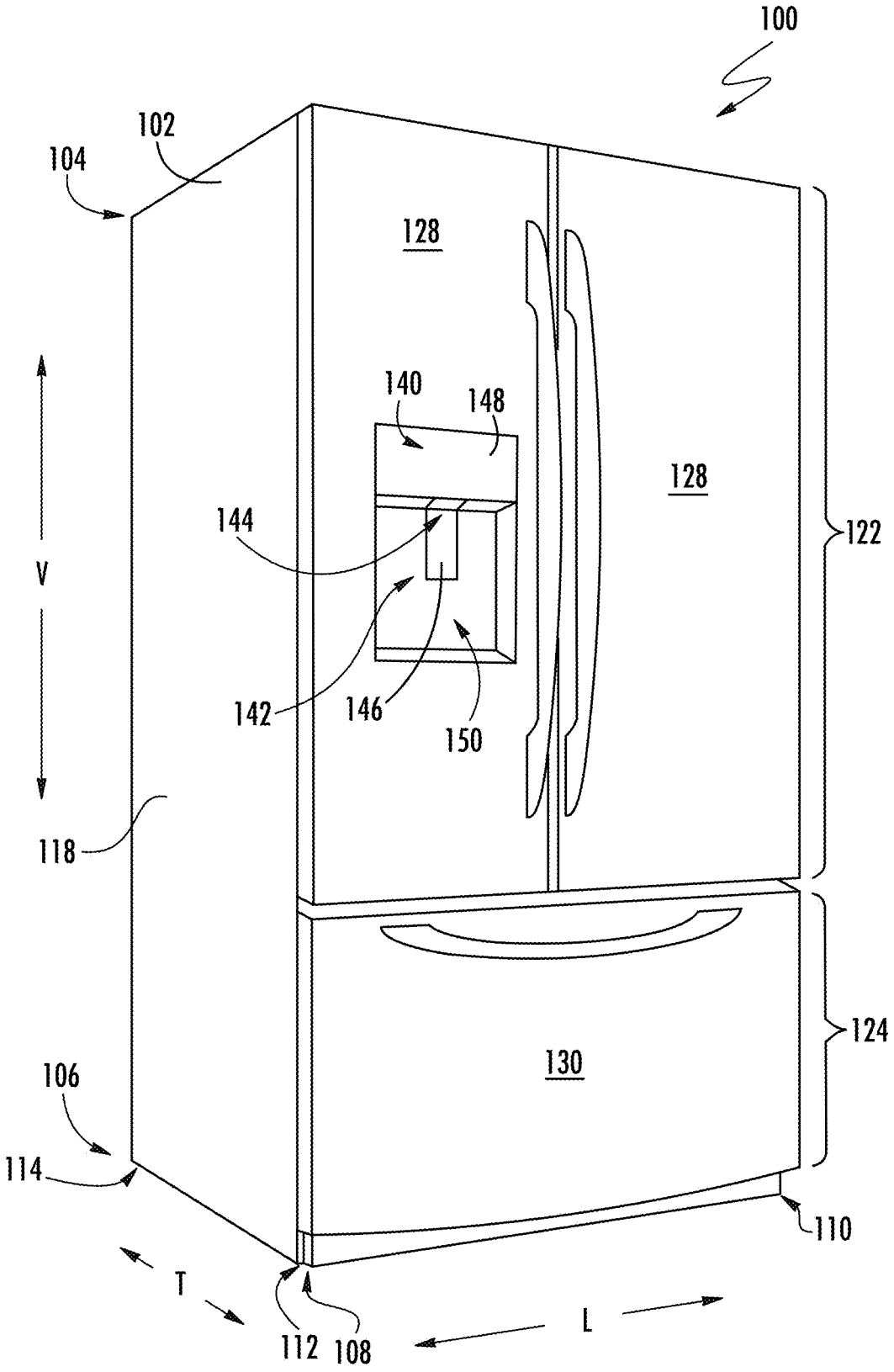
FIG. 1 provides a perspective view of a refrigerator appliance according to one or more example embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

As explained herein, aspects of the present subject matter are generally directed to a system and method of connecting two tubes in a refrigerator harness housing to prevent leakage of insulating foam through the connection point during the foaming process. For example, a blow molded tube may be connected to an injection molded tube that has a two concentric diameter tube interface. The blow molded tube may fit inside the larger diameter and outside the smaller diameter tube of the injection molded part. The outer surface of the blow molded part may be tightly controlled and angled, so that the tubes are snapped in place, and the outer ribs of the blow molded part are pressed against the inside surface of the larger diameter injection molded tube and deform slightly, which creates a seal. Along with this, the injection molded part may have two concentric diameter tubes causes the foam to travel twice the distance before it can reach the interior if there is an incomplete seal. The tube connection may be locked in place via snap fits, and a key may be added so that it cannot be assembled backward. The waterline may be fed from the harness housing to the waterline conduit, from a larger diameter tube to a smaller diameter tube which decreases the risk of the waterline getting snagged during assembly.

Other aspects of the present subject matter are generally directed to a refrigerator that includes a leak proof interface to reduce leaks between connection points. The leak proof interface may include a rigid plastic part with a flexible plastic part, there may be a snap fit connection between the plastic parts, the bottom flange of the part may be deformed because the underside of the plastic part is drafted outwards. This may create a seal to prevent foam leaks through the connection point. A wire harnesses or other thin parts/tubes may be routed from the inside to the outside of a unit routes the plastic part. A plastic or rubber grommet may guide the wire harnesses through a plastic harness housing so that during the foaming process, the grommet decreases or eliminates foam leaks through the plastic harness housing after the harnesses are routed through it.

Figure 2:
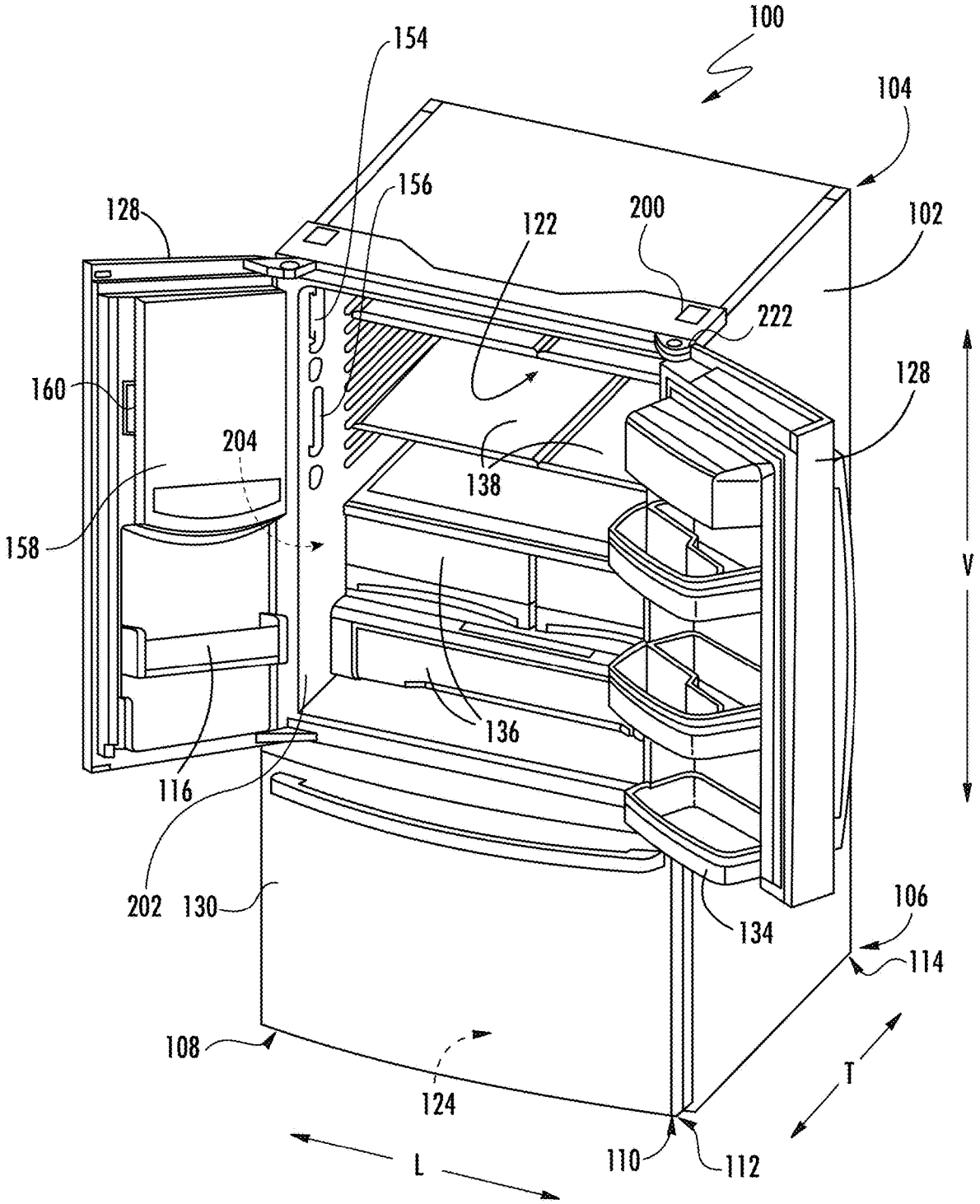
FIG. 2 provides an additional perspective view of the refrigerator appliance of FIG. 1 with doors of the refrigerator appliance in an open position.

Referring now to the figures, FIGS. 1 and 2 provide perspective views of an exemplary household appliance, which in the illustrated example is a refrigerator appliance 100, according to one or more exemplary embodiments of the present subject matter. The household appliance, e.g., refrigerator appliance, may define a vertical direction V, a lateral direction L, and a transverse direction T. The vertical direction V, the lateral direction L, and the transverse direction T may each be mutually perpendicular to one another to generally form an orthogonal coordinate system.

As illustrated in FIGS. 1 and 2, the refrigerator appliance 100 may include a housing or a cabinet 102 that may extend between a top 104 and a bottom 106 approximately along a vertical direction V, between a first side (left side) 108 and a second side (right side) 110 approximately along a lateral direction L, and between a front 112 and a back 114 approximately along a transverse direction T. The cabinet 102 may define one or more chilled chambers for receipt of food items for storage. In some embodiments, the cabinet 102 may define a fresh food chamber 122 positioned at or adjacent the top 104 of the cabinet 102 and a freezer chamber 124 arranged at or adjacent the bottom 106 of the cabinet 102. As such, the refrigerator appliance 100 may generally be referred to as a bottom mount refrigerator.

It is recognized, however, that the benefits of the present disclosure apply to other types and styles of refrigerator appliances such as, for example, a top mount refrigerator appliance, a quad door refrigerator appliance, a side-by-side refrigerator, a standalone (single chamber) refrigerator or freezer appliance, or other household appliances which generally include a cabinet with one or more doors rotatably mounted to the cabinet. Consequently, the description set forth herein is for illustrative purposes only and is not intended to be limiting in any aspect to any particular household appliance, such as the present subject matter is not limited to any particular refrigerator chamber configuration, or the presence of a refrigerator chamber at all. For example, the present subject matter may also be used with household appliances having a cooking chamber (e.g., in a range or wall oven or microwave) or a laundry treatment chamber (e.g., in a washing machine appliance, dryer appliance, or combination washer-dryer appliance). Accordingly, it should be recognized that aspects of the present disclosure, such as the locator rail and hinge brackets, may be used with a variety of household appliances, such as any household appliance having a cabinet, a chamber defined within the cabinet, and a door rotatably mounted to the cabinet to selectively at least partially enclose the chamber.

The refrigerator doors 128 may be rotatably hinged to an edge of the cabinet 102 for selectively accessing the fresh food chamber 122. In addition, a freezer door 130 may be arranged below the refrigerator doors 128 for selectively accessing the freezer chamber 124. The freezer door 130 may be coupled to a freezer drawer (not shown) slidably mounted within the freezer chamber 124. The refrigerator doors 128 and the freezer door 130 may be shown in the closed configuration in FIG. 1.

In some embodiments, various storage components may be mounted within the fresh food chamber 122 to facilitate storage of food items therein. In particular, the storage components may include storage bins 134, drawers 136, and shelves 138 that may be mounted within the fresh food chamber 122. As such, the storage bins 134, drawers 136, and shelves 138 are configured for receipt of food items, for example, beverages or solid food items, and may assist with organizing such food items. As an example, the drawers 136 can receive fresh food items, for example, vegetables, fruits, or cheeses, and increase the useful life of such fresh food items.

In some embodiments, the refrigerator appliance 100 may also include a dispensing assembly 140 for dispensing liquid water or ice. The dispensing assembly 140 may include a dispenser 142, for example, positioned on or mounted to an exterior portion of the refrigerator appliance 100, such as on one of the refrigerator doors 128. Moreover, as shown in FIG. 1, the dispenser 142 may include a discharging outlet 144 for accessing ice and liquid water. Further, an actuating mechanism 146, shown as a paddle, may be mounted below the discharging outlet 144 for operating the dispenser 142. In alternative embodiments, any suitable actuating mechanism may be used to operate the dispenser 142. A user interface panel 148 may also be provided for controlling the mode of operation. For example, the user interface panel 148 may include a plurality of user inputs (not labeled), such as a water dispensing button and an ice-dispensing button, for selecting a desired mode of operation such as crushed or non-crushed ice.

Still referring to FIG. 1, the discharging outlet 144 and actuating mechanism 146 may be an external part of the dispenser 142 and may be mounted in a dispenser recess 150. The dispenser recess 150 may be positioned at a predetermined elevation convenient for a user to access ice or water and enabling the user to access ice without the need to bend-over and without the need to open the refrigerator doors 128. In additional embodiments, the dispenser recess 150 may be positioned at a level that approximates the chest level of a user.

In further embodiments, for example, as shown in FIG. 2, the refrigerator appliance 100 may include a sub-compartment 152 defined on the refrigerator door 128. The sub-compartment 152 is often referred to as an "icebox." Further, the sub-compartment 152 may extend into fresh food chamber 122 when the refrigerator door 128 is in the closed position. Although the sub-compartment 152 is shown in the refrigerator door 128, additional or alternative embodiments may include the sub-compartment 152 fixed within fresh food chamber 122. In an embodiment, an ice maker and/or an ice storage bin (not shown) may be positioned or disposed within the sub-compartment 152. Accordingly, during use, ice can be supplied to the dispenser recess 150, see, for example, FIG. 1, from the ice making assembly or ice storage bin in the sub-compartment 152 on a back side of refrigerator door 128.

In additional or alternative embodiments, chilled air from a sealed system (not shown) of the refrigerator appliance 100 may be directed into components within the sub-compartment 152. For instance, the sub-compartment 152 may receive cooling air from a chilled air supply duct 154 and a chilled air return duct 156, see, for example, FIG. 2, disposed on a side portion of cabinet 102 of the refrigerator appliance 100. In this manner, the chilled air supply duct 154 and the chilled air return duct 156 may recirculate chilled air from a suitable sealed cooling system through the sub-compartment 152.

In optional embodiments, for example, as illustrated in FIG. 2, an access door 158 may be hinged to the refrigerator door 128. Thus, the access door 158 may permit selective access to the sub-compartment 152. Any manner of suitable latch 160 may be configured with the sub-compartment 152 to maintain the access door 158 in a closed position. As an example, the latch 160 may be actuated by a user in order to open the access door 158 for providing access into the sub-compartment 152. The access door 158 can also assist with insulating the sub-compartment 152 (e.g., by thermally isolating or insulating the sub-compartment 152 from the fresh food chamber 122). It is noted that although the access door 158 is illustrated in exemplary embodiments, alternative embodiments may be free of any separate access door.

Referring now generally to FIGS. 2 through 9, refrigerator appliance 100 may include a harness connecting assembly 200 that is generally configured to house and/or support one or more wires, conduits, supply lines, or other components of refrigerator appliance 100. For example, harness connecting assembly 200 may be positioned within cabinet 102, e.g., between cabinet 102 and a chamber liner 202 (e.g., chamber liner 202 may define fresh food chamber 122 and freezer chamber 124). According to example embodiments, the space between cabinet 102 and chamber liner 202 may be injected with spray foam 204 to provide rigidity to chamber liner 202 and to insulate fresh food chamber 122 and freezer chamber 124. Although an example harness connecting assembly 200 is described below, it should be appreciated that variations and modifications may be made while remaining within the scope of the present subject matter.

As shown, harness connecting assembly 200 may include a harness housing 210 that is mounted to cabinet 102 and is spray-foamed in place, e.g., between chamber liner 202 and cabinet 102. Specifically, cabinet 102 may define a cabinet aperture 212 through which a portion of harness housing 210 passes and is positioned above top 104 of cabinet 102. Harness housing 210 may include a support flange 214 that is seated directly against cabinet 102 surrounding cabinet aperture 212 and a plurality of clips 216 may be used to secure harness housing 210 to cabinet 102. It should be appreciated that other attachment methods are possible and within the scope of the present subject matter.

According to an example embodiment, harness housing 210 may be used to facilitate the routing of a water supply line 220 that is used to supply water to dispensing assembly 140. In this regard, water supply line 220 typically passes through cabinet 102 between cabinet 102 and chamber liner 202 (e.g., where spray foam 204 is eventually injected). For example, water supply line 220 passes from rear side 114 of cabinet to harness housing 210, which may be positioned adjacent a door hinge 222 of refrigerator door 128. Notably, as explained above, spray foam 204 is typically injected in the space where water supply line 220 is routed, e.g., prior to installation of water supply line 220. Accordingly, harness connecting assembly 200 may include additional features to facilitate routing of water supply line 220 after spray foam 204 has been applied.

In this regard, for example, harness connecting assembly 200 may include a waterline conduit 224 that is installed in cabinet 102 before injecting cabinet 102 with spray foam 204. Water supply line 220 may be routed through waterline conduit 224 after spray foam 204 has cured and at a later time in the manufacturing process. According to the illustrated embodiment, harness housing 210 may further define a conduit adapter 226 that is generally configured to securely receive waterline conduit 224. In this regard, as described in more detail below, conduit adapter 226 may include a snap-fit connection with water supply line 220 that requires very little effort from the installation technician, requires no additional supplied (e.g., such as tape or connectors), and results in a foam-tight connection.

According to an example embodiment, waterline conduit 224 defines a connecting portion 230 for receipt within conduit adapter 226. For example, conduit adapter 226 includes an inner sleeve 232 and an outer sleeve 234 that are concentric to each other and define a receiving groove 236 for receiving connecting portion 230 of waterline conduit 224. According to an example embodiment, a depth of receiving groove 236 is greater than a length of connecting portion 230 of waterline conduit 224. In this manner, connecting portion 230 may be engaged deep within receiving groove 236, thereby creating a long pathway for spray foam 204 to travel if it is to reach within waterline conduit 224. In this regard, due to the elongated path created at the connection between connecting portion 230 and waterline conduit 224, spray foam 204 may have a tendency to harden or cure before entering waterline conduit 226.

In addition, according to an example embodiment, an inner diameter 240 of inner sleeve 232 may be smaller than an inner diameter 242 of waterline conduit 224. In this manner, an installation technician may slide water supply line 220 through harness housing 210 (e.g., through a housing aperture 244), through conduit adapter 226, and into waterline conduit 224 toward rear 114 of cabinet 102 without contacting a lip within waterline conduit 226, thus resulting in simplified assembly.

According to the illustrated example embodiment, connecting portion 230 of waterline conduit 224 may further include a plurality of protruding ribs 250 extending from an outer surface of waterline conduit 226. For example, connecting portion 230 is illustrated as having three protruding ribs 250 that extend outward along a radial direction to engage outer sleeve 234 of conduit adapter 226. In this manner, protruding ribs 250 may be slightly deformed to create an improved seal. In addition, protruding ribs 250 may form several voids along a potential leak path of spray foam 204. Notably, these areas permit the flow of spray foam 204 to expand slightly, which results in quicker hardening or curing of spray foam 204, further sealing the joint and preventing further passage of spray foam 204.

In addition, as illustrated, waterline conduit 224 may define an alignment feature 252 and conduit adapter 226 may have a complementary feature 254 that are generally intended to ensure proper alignment and installation of waterline conduit 224 (or to prevent incorrect installation). In this regard, for example, waterline conduit 224 is receivable within conduit adapter 226 only when alignment feature 252 and complementary feature 254 are aligned. For example, alignment feature 252 may be a radial protrusion and complementary feature 254 may be a radial recess. It should be appreciated that other keyed features are possible and within the scope of the present subject matter.

In addition, in order to secure waterline conduit 224 along the axial direction, e.g., to prevent waterline conduit 224 from pulling away from harness housing 210, waterline conduit 224 and conduit adapter 226 may include one or more snap-lock mechanisms. For example, waterline conduit 226 may define a locking protrusion 260 and harness housing 210 may define a locking clip 262 that engages locking protrusion 260 when waterline conduit 224 is properly received within conduit adapter 226 (e.g., when waterline conduit 226 is pressed into place). It should be appreciated that other snap-fit or locking mechanisms may be used while remaining within the scope of the present subject matter.

Figure 3:
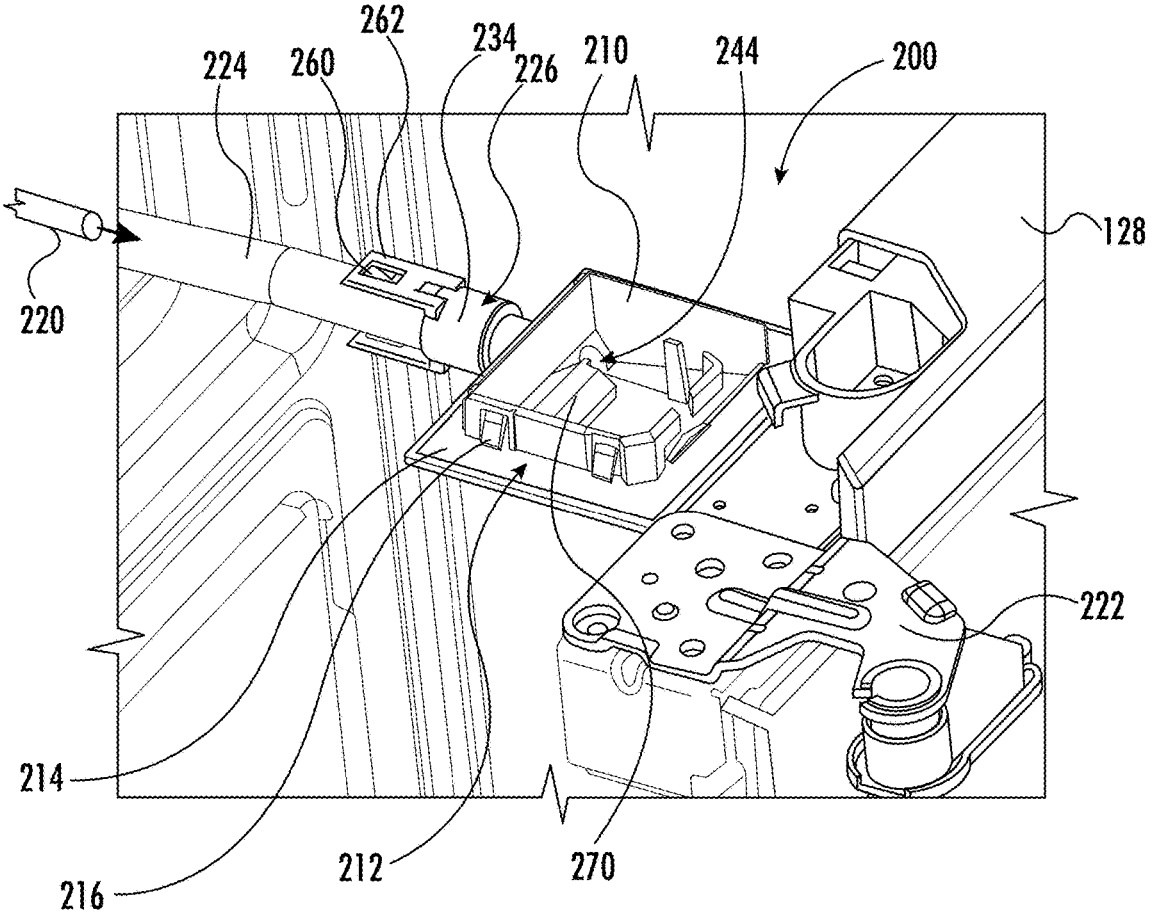
FIG. 3 provides a perspective view of a harness connecting assembly mounted to a cabinet of the example refrigerator appliance of FIG. 1 according to one or more example embodiments of the present subject matter.
Figure 4:
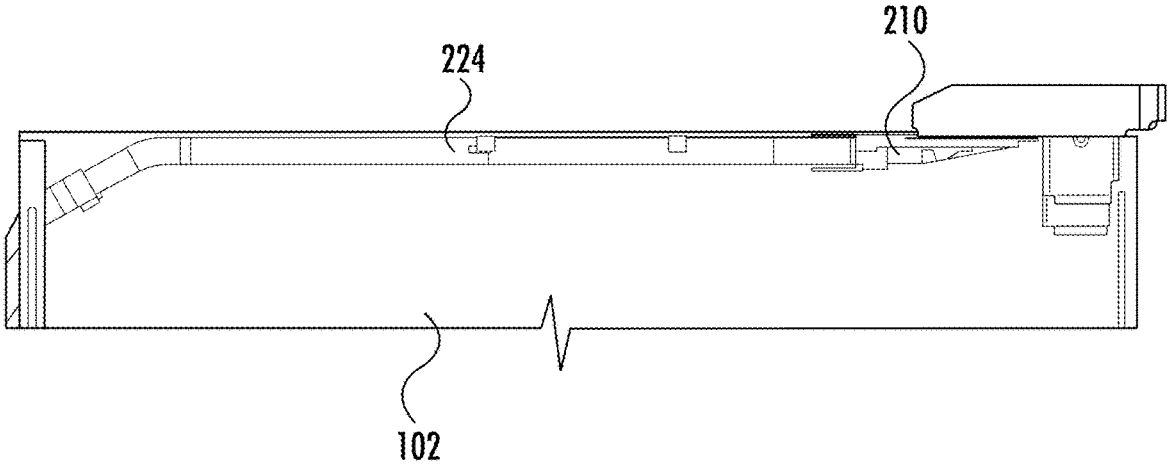
FIG. 4 provides a side view of the example harness connecting assembly of FIG. 3 according to an example embodiment of the present subject matter.
Figure 5:
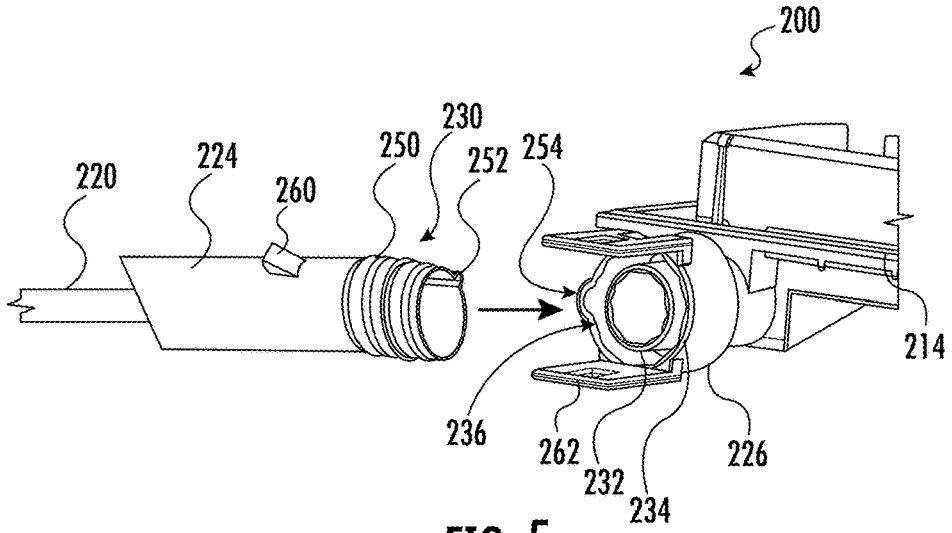
FIG. 5 provides a perspective view of the example harness connecting assembly of FIG. 3 according to an example embodiment of the present subject matter.
Figure 6:
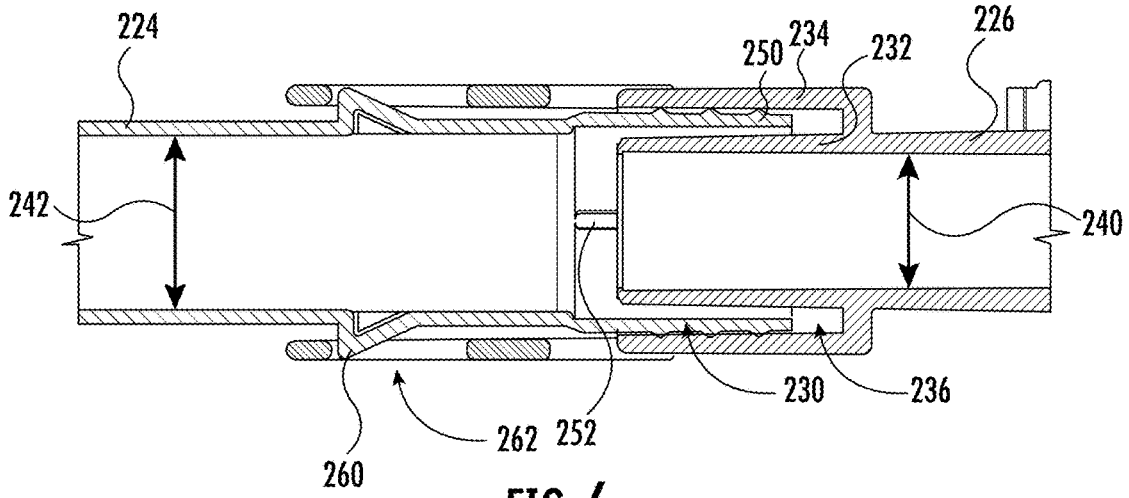
FIG. 6 provides a cross-sectional view of the example harness connecting assembly of FIG. 3 according to an example embodiment of the present subject matter.
Figure 7:
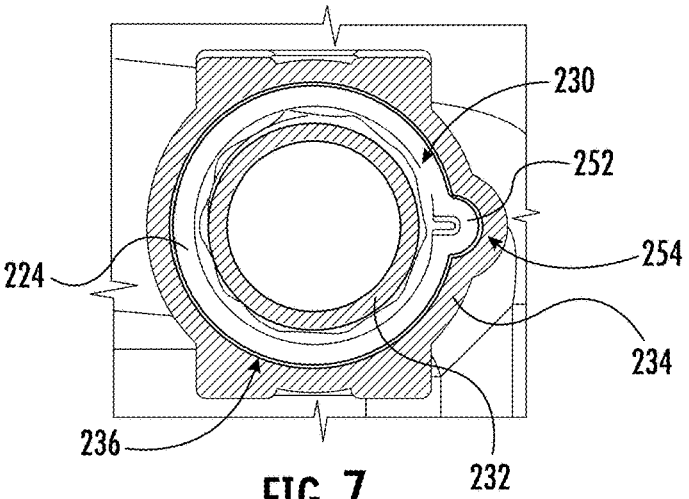
FIG. 7 provides another cross-sectional view of the example harness connecting assembly of FIG. 3 according to an example embodiment of the present subject matter.
Figure 8:
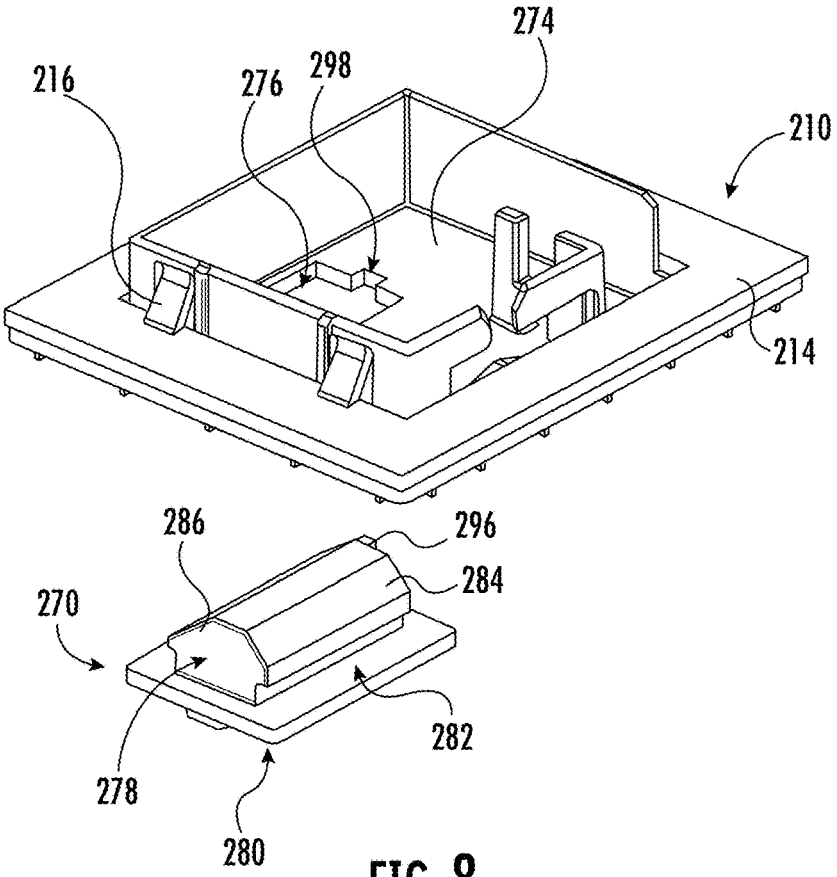
FIG. 8 provides a perspective view of the example harness connecting assembly of FIG. 3 according to an example embodiment of the present subject matter.
Figure 9:
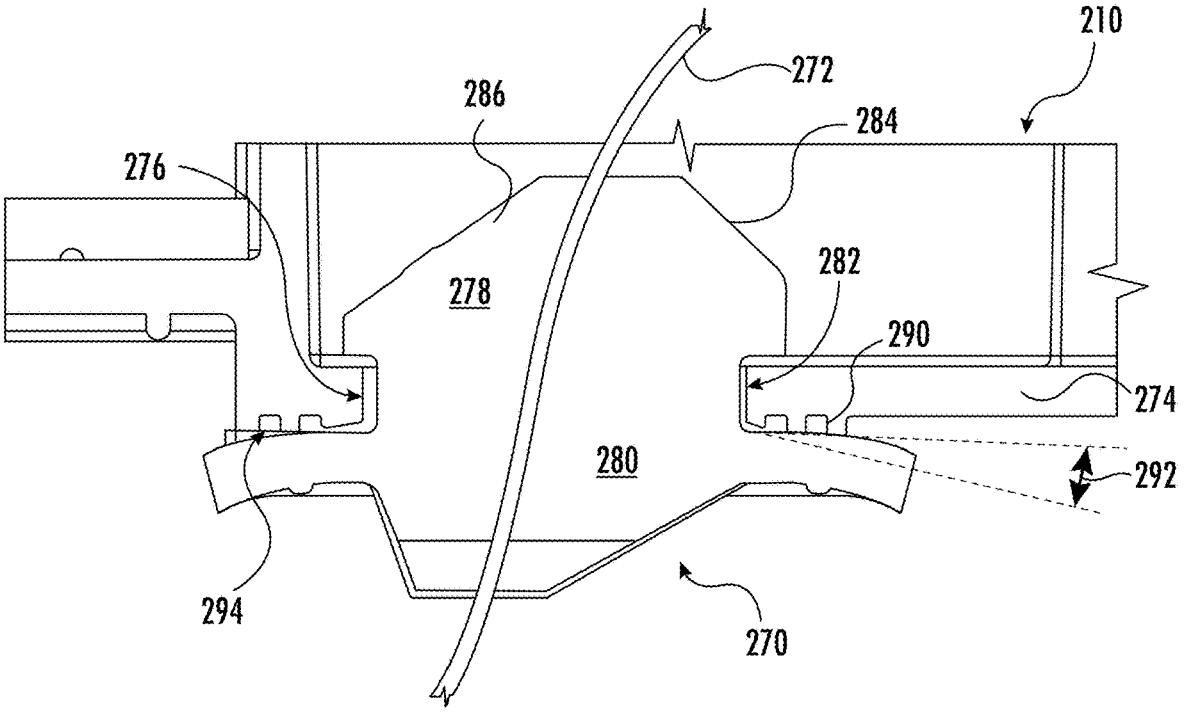
FIG. 9 provides a cross-sectional view of the example harness connecting assembly of FIG. 3 according to an example embodiment of the present subject matter.

Referring now specifically to FIGS. 3, 8, and 9, harness housing 210 may further include a grommet 270 that is intended to house one or more wires, pipes, conduits, etc. For example, as illustrated in FIG. 9, one or more wires or a wiring harness 272 may be molded into grommet 270 such that inserting grommet 270 into harness housing 210 secures wiring harness 272 in place within cabinet 102. In this regard, harness housing 210 may include a bottom wall 274 that defines an aperture 276 through which grommet 270 may be inserted. In this regard, grommet 270 may have an upper portion 278 and a lower portion 280 separated by a locking groove 282 that engages aperture 276 of harness housing 210 to secure grommet 270 in place.

For example, upper portion 278 may define a first angled surface 284 and a second angled surface 286 that facilitate insertion of grommet 270. According to an example embodiment, first angled surface 284 is shorter than second angled surface 286 to permit an installation technician to install grommet 270 by pivoting it into place within aperture 276. According to an example embodiment, a depth of locking groove 282 may be equal to a height of bottom wall 274 of harness housing 210 at an inner edge of aperture 276, thereby reducing the likelihood of spray foam 204 leaking through aperture 276.

Notably, to further reduce the likelihood of spray foam 214 leaking, bottom wall 274 may be tapered or drafted such that bottom wall 274 of harness housing 210 is thicker further away from aperture 276. In this regard, bottom wall 274 may define an angled wall 290 that extends at an angle 292 away from aperture 276. Notably, this angle 292 may cause lower portion 280 of grommet 270 to deflect and form a tighter seal against harness housing 210. Angle 292 may be between about 1° and 45°, between about 3° and 30°, between about 10° and 20°, or about 15°. In addition, one or more recesses 294 may be defined in angled wall 290 where grommet 270 engages angled wall 290. Similar to the gaps adjacent to protruding ribs 250, these recesses 294 may provide space for spray foam 204 to expand and harden, thus further reducing the likelihood of spray foam 204 leakage through aperture 276.

In addition, as illustrated, grommet 270 may define an alignment feature 296 and harness housing 210 may have a complementary feature 298 that are generally intended to ensure proper alignment and installation of grommet 270 (or to prevent incorrect installation). In this regard, for example, grommet 270 is receivable within aperture 276 only when alignment feature 296 and complementary feature 298 are aligned. For example, alignment feature 296 may be a notch or chamfered edge and complementary feature 298 may be recess having a complementary geometry. It should be appreciated that other keyed features are possible and within the scope of the present subject matter.

In general, harness housing 210, waterline conduit 224, and grommet 270 may be formed from any suitable material(s). For example, harness housing 210 may be injection molded, e.g., using a suitable plastic material, such as injection molding grade Polybutylene Terephthalate (PBT), Nylon 6, high impact polystyrene (HIPS), acrylonitrile butadiene styrene (ABS), or any other suitable blend of polymers. Alternatively, according to the exemplary embodiment, these components may be compression molded, e.g., using sheet molding compound (SMC) thermoset plastic or other thermoplastics. In addition, according to an example embodiment, waterline conduit 224 may be blow molded and grommet 270 may be overmolded with a rubber material. Other manufacturing materials and methods are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chilled chamber;

a door being rotatably mounted to the cabinet to provide selective access to the chilled chamber;

a harness housing mounted to the cabinet and defining a conduit adapter; and a waterline conduit routed through the cabinet, the waterline conduit defining a connecting portion for receipt within the conduit adapter and a plurality of protruding ribs extending from an outer surface of the waterline conduit, wherein the conduit adapter comprises an inner sleeve and an outer sleeve, the inner sleeve and the outer sleeve being concentric to define a receiving groove for receiving the connecting portion of the waterline conduit.

2. The refrigerator appliance of claim 1, wherein a depth of the receiving groove is greater than a length of the connecting portion of the waterline conduit.

3. The refrigerator appliance of claim 1, wherein an inner diameter of the inner sleeve is smaller than an inner diameter of the waterline conduit.

4. The refrigerator appliance of claim 1, wherein the plurality of protruding ribs engages an outer sleeve of the conduit adapter.

5. The refrigerator appliance of claim 1, wherein the waterline conduit defines an alignment feature and the conduit adapter has a complementary feature, wherein the waterline conduit is receivable within the conduit adapter when the alignment feature and the complementary feature are aligned.

6. The refrigerator appliance of claim 5, wherein the alignment feature is a radial protrusion and the complementary feature is a radial recess.

7. The refrigerator appliance of claim 1, wherein the waterline conduit defines a locking protrusion and the harness housing defines a locking clip, wherein the locking clip engages the locking protrusion when the waterline conduit is properly received within the conduit adapter.

8. The refrigerator appliance of claim 1, wherein the harness housing is positioned adjacent a door hinge of the door and the waterline conduit extends from a back of the cabinet to the harness housing.

9. The refrigerator appliance of claim 1, further comprising:

a water supply line passing through a center of the waterline conduit.

10. The refrigerator appliance of claim 1, wherein the harness housing is injection molded and the waterline conduit is blow molded.

11. The refrigerator appliance of claim 1, wherein the harness housing is received within a cabinet aperture in the cabinet and comprises a plurality of clips to secure the harness housing to the cabinet.

12. The refrigerator appliance of claim 1, further comprising:

spray foam injected into the cabinet around the waterline conduit.

13. A harness connecting assembly for a refrigerator appliance, the refrigerator appliance comprising a cabinet defining an aperture, the harness connecting assembly comprising:

a harness housing inserted through the aperture of the cabinet, the harness housing comprising a plurality of clips to secure the harness housing to the cabinet and a conduit adapter; and a waterline conduit routed through the cabinet, the waterline conduit defining a connecting portion for receipt within the conduit adapter and a plurality of protruding ribs extending from an outer surface of the waterline conduit to engage the conduit adapter, wherein the conduit adapter comprises an inner sleeve and an outer sleeve, the inner sleeve and the outer sleeve being concentric to define a receiving groove for receiving the connecting portion of the waterline conduit.

14. The harness connecting assembly of claim 13, wherein a depth of the receiving groove is greater than a length of the connecting portion of the waterline conduit.

15. The harness connecting assembly of claim 13, wherein an inner diameter of the inner sleeve is smaller than an inner diameter of the waterline conduit.

16. The harness connecting assembly of claim 13, wherein the waterline conduit defines an alignment feature and the conduit adapter has a complementary feature, wherein the waterline conduit is receivable within the conduit adapter when the alignment feature and the complementary feature are aligned.

17. The harness connecting assembly of claim 16, wherein the alignment feature is a radial protrusion and the complementary feature is a radial recess.

18. The harness connecting assembly of claim 13, wherein the waterline conduit defines a locking protrusion and the harness housing defines a locking clip, wherein the locking clip engages the locking protrusion when the waterline conduit is properly received within the conduit adapter.

* * * * *